United States Patent [19]

Eyler

[11] Patent Number: 4,570,306

[45] Date of Patent: Feb. 18, 1986

[54] RELEASABLE UPHOLSTERY TIE

[76] Inventor: Ronald Eyler, 1544 Jefferson Blvd., Hagerstown, Md. 21740

[21] Appl. No.: 680,525

[22] Filed: Jan. 28, 1985

[51] Int. Cl.[4] ..... A44B 1/18; A47C 31/02

[52] U.S. Cl. ..... 24/90 B; 24/90 C; 24/704; 24/102 T; 5/472

[58] Field of Search ..... 24/90 B, 90 C, 90 TA, 24/90.5, 91, 102 T, 103, 114.5, 111, 16 PB, 17 AP, 30.5 P, 704; 5/471, 472, 408, 410; 248/74.4

[56] References Cited

U.S. PATENT DOCUMENTS

| | | | |
|---|---|---|---|
| 69,295 | 9/1867 | Zeller | 24/30.5 P |
| 1,715,258 | 5/1929 | Tonn | 24/90 C |
| 1,867,041 | 7/1932 | Walters | 5/472 |
| 2,262,161 | 11/1941 | Blumstock | 24/102 T |
| 2,284,274 | 5/1942 | Fridolph | 5/472 |
| 2,931,607 | 4/1960 | McFarland | 24/704 |
| 2,999,285 | 9/1961 | Morton et al. | 24/102 T |
| 3,584,525 | 6/1971 | Caveney | 24/16 PB |
| 3,771,199 | 11/1973 | Eldringhoff | 24/90 B |
| 3,780,400 | 12/1973 | Hinsperger | 24/16 PB |
| 3,816,881 | 6/1974 | Van Riper, Jr. | 5/472 |
| 3,938,224 | 2/1976 | Delahousse et al. | 5/472 |
| 3,972,093 | 8/1976 | Aimar | 5/472 |
| 4,136,148 | 1/1979 | Joyce | 24/16 PB |

FOREIGN PATENT DOCUMENTS

| | | | |
|---|---|---|---|
| 845995 | 7/1970 | Canada | 24/16 PB |
| 1411972 | 10/1975 | United Kingdom | 24/90 B |

*Primary Examiner*—Victor N. Sakran

[57] ABSTRACT

A releasable, two-piece upholstery tie for use in the upholstery trade for the fastening of upholstery buttons to finished upholstered items. The locking mechanism of the tie incorporates a self-contained release mechanism protected from inadvertent or accidental release by virtue of the fact that the release mechanism is only accessible through a small aperture in the side of the locking mechanism, through which a pin or other sharp object is inserted for needed release and readjustment.

1 Claim, 9 Drawing Figures

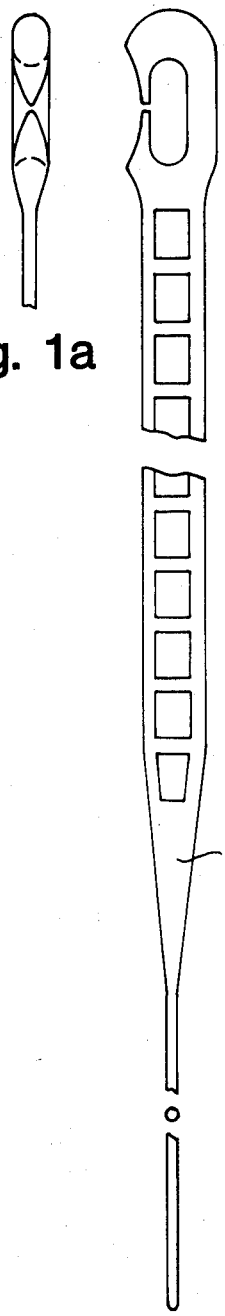
Fig. 1a
Fig. 1
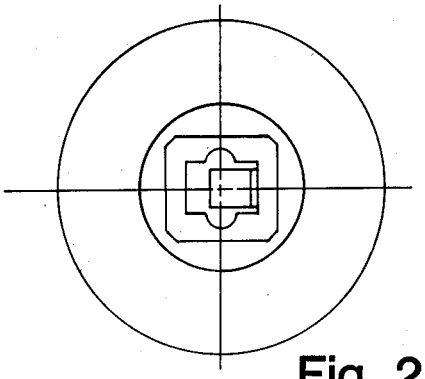
Fig. 2a
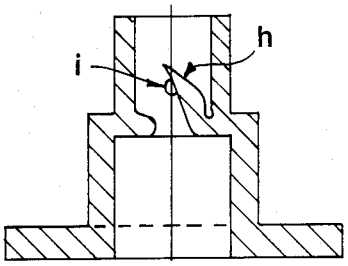
Section A – A
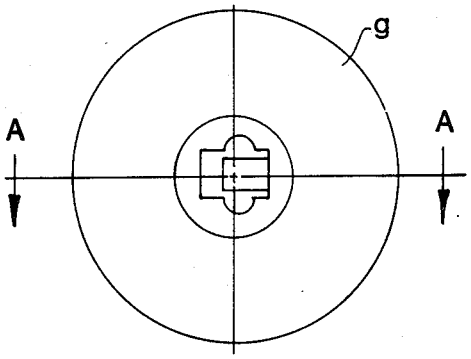
Fig. 2

RELEASABLE UPHOLSTERY TIE

BACKGROUND OF THE INVENTION

In the upholstery trade, buttons are fastened to an upholstered piece by needle and thread, prong buttons, nail and washer, strap or loop. The methodology of some of the aforementioned methods necessitates laborious and methodical hand labor, and the proposed invention is more flexible, in that it can be used synonymously for all of the heretofore existing aforementioned modes of tying and anchoring upholstery buttons. The only exception would be when there is a tufting button located on both sides of the upholstered article such that they are positioned in a back-to-back manner and this exception would still be carried out by hand-using one of the old methods.

The invention relates to two-piece upholstery ties, and more particularly, to such ties having release means for releasing the tie after it has been tightened. One-piece plastic cable ties for bundling a plurality of elongate objects such as wires have come into common use in the last two decades. Such ties typically include a locking head having a toothed locking pawl pivotally mounted and extending into a strapreceiving aperature, and a strap having a series of transverse teeth on one surface thereof for engagement with the pawl. These prior art ties are available in both releasable and non-releasable versions, with the former generally having a short lever or tab extending from the pawl beyond the strap exit face of the locking head. In releasing the tie, the strap must be pulled at least a short distance through the locking head in the strap tightening direction to allow the pawl to pivot toward the strap exit face and out of engagement with the strap. Of course, the force required to release the strap is a function of the force previously used in applying the tie.

A projecting release strap is impractical in working in the upholstery business where such projecting release strap would be permanently located interally within the tufting and padding of the upholstered article where the pressure of the body sitting upon it or leaning against it might eventually release it, thereby loosening the button and upholstery tie itself.

In the instant invention, the means of release is integrated into the locking device itself with a small aperture located in the side of the device which can be accessed only by the upholsterer by inserting a pin or other sharp object to trip the release lever should the craftsman himself have a necessity to release or readjust the locking pawl after which it becomes permanently locked and secured as required (see FIG. 7-*i*).

SUMMARY OF THE INVENTION

Among the several objects of the present invention may be noted the provision of an improved cable tie having a release means inherent in the locking mechanism itself which is activated by inserting a pin or metal object in an aperture in the side of the lock mechanism to obviate the presence of a release tab on the outside of the locking mechanism itself which, particularly in upholstery work, may inadvertently be activated to release the strap from the pressure of the surrounding batting and cushioning or from the pressure of the human body on the piece of furniture which is upholstered with this proposed tufting button and plastic cable tie mechanism. The purpose of this proposed design is to ensure readily a means of releasing the cable tie by the upholstery workman himself should there be need for readjustment or realignment or loosening of the tie in the process of the actual upholstery procedure by ensuring that the final positioning of the tie by the workman will remain exactly as he positions it and will not later work its way loose accidentally or from pressure applied to the upholstered piece of furniture.

Further, the design of this proposed tufting button will facilitate the speed of assembly of hand-tufted upholstery items and ensure longevity and prolonged wear and tear of the article so upholstered with these proposed devices.

BRIEF DESCRIPTION OF THE DRAWINGS

FIG. 1 shows the design of the strap.

FIG. 2 shows the design of the fastener head.

BRIEF DESCRIPTION OF THE EMBODIMENT

Figure 3:
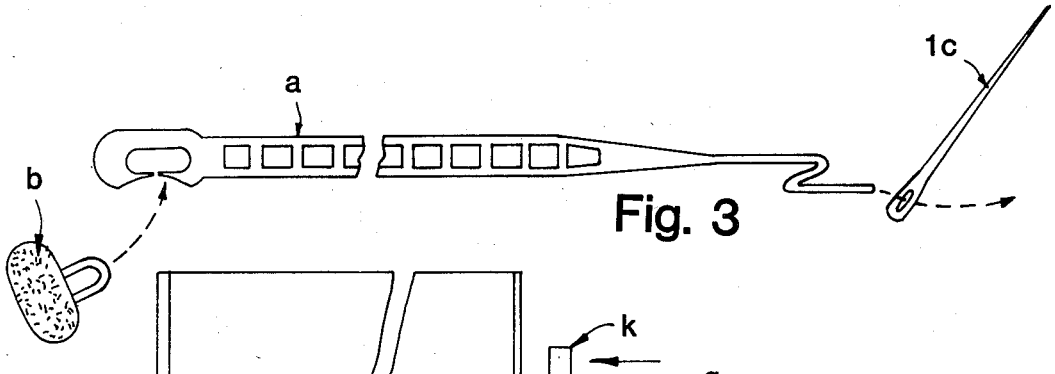
FIG. 3 illustrates the set-up for use of the strap.

In the illustrated embodiment of the invention, the strap (a) in FIG. 3 has a button (b) attached to the hook eye. On the opposite end, a thread-like appendage is threaded through an upholstery needle (c) for application.

Figure 4:
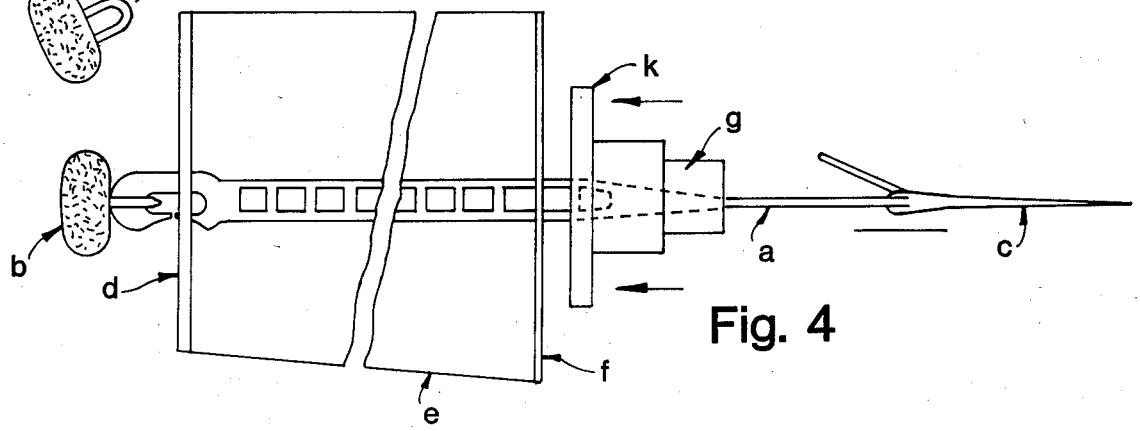
FIG. 4 illustrates the strap and fastener head as they are installed to a piece being upholstered.
Figure 5:
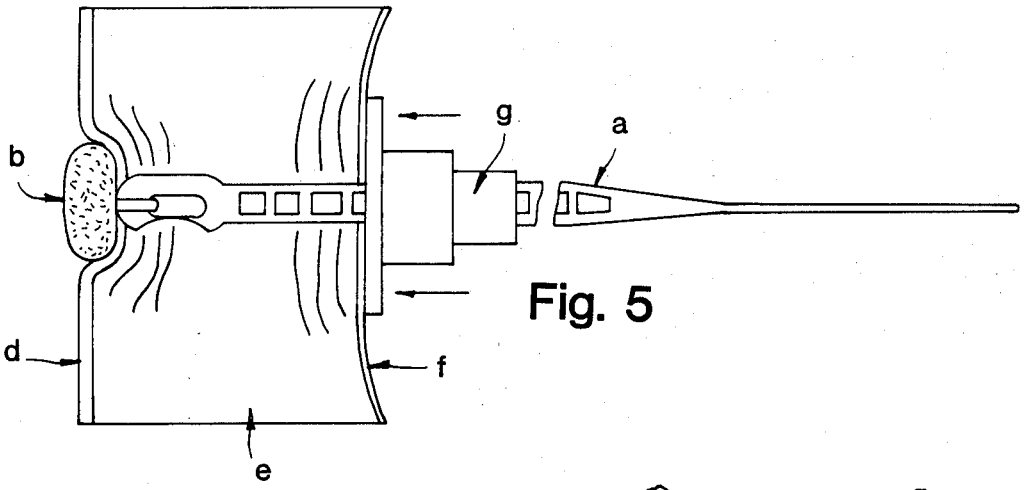
FIG. 5 is a view through upholstered piece showing final stages of fastening the button and the strap and fastener head assembly.
Figure 6:
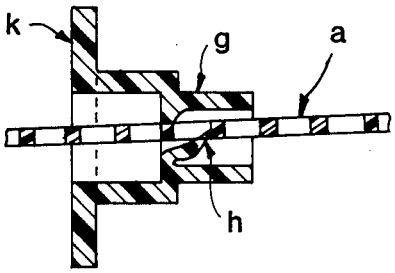
FIG. 6 illustrates a section through the strap and fastener head showing how the ratchet pawl relates to the strap.
Figure 7:
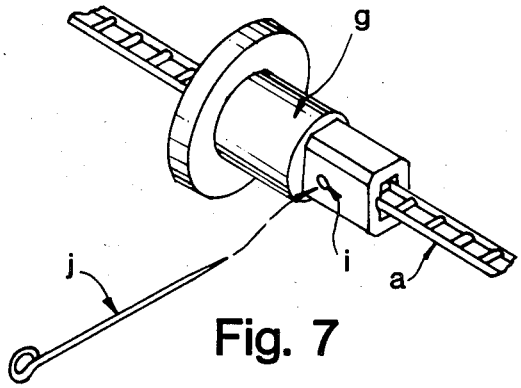
FIG. 7 is an isometric view showing fastener head release for the strap.

In FIG. 4, needle (c) is inserted at location of installation of button (b) into upholstery material (d), filler (e), and backing material (f). At this stage, the needle (c) drops off. The appendage on the strap (a) is then threaded through fastener head (g) in such a manner as to locate the flange (k) side against the backing material (f). The strap (a) is pulled through the upholstery material, and pressure is applied manually to the fastener head (g) to snug up button (b) to the desired tension as shown in FIG. 5.

The tension of the button is held by the ratchet pawl (h) in the fastener head (g). In the event too much tension has been put on the button (b) and fastener head (g), a hole (i) is provided to which an upholstery pin (j) may be inserted at the same time tension is relieved on ratchet pawl (h). The insertion of the pin (j) into hole (i) will pull the ratchet pawl (h) down from the ladder portion of the strap (a) and the fastener head (g) may be loosened to have proper tension applied.

What is claimed is:

1. A releasable adjustable upholstery tying device assembly for fastening buttons to upholstered furniture, said device formed of a flexible nylon material, and consisting of two parts—a strap and a fastener head; said strap comprising a ladder-like structure with a hook on one end and a thread-like appendage on the other end, said hook end of the strap is attached to a button, and the thread-like end is threaded through an upholstery needle, which will then be inserted through the upholstery material and filling, said thread-like end is then threaded through the fastener head and snugged up to bring the button to the desired position, said fastener head further including a pawl and an aperture adjusting means as a second part of the releasable upholstery tying device, wherein the ratchet pawl engaging and holding said strap in the designated position and means to be inserted through said aperature for facilitating the release of said ratchet pawl.

* * * * *